US005412364A

United States Patent [19]

Iguchi et al.

[11] Patent Number: 5,412,364

[45] Date of Patent: May 2, 1995

[54] TONER PACK AND DEVELOPMENT DEVICE FOR USE IN ELECTROPHOTOGRAPHIC APPARATUS

[75] Inventors: Michihisa Iguchi; Hiroshi Hashizume; Seiji Arai; Yoshiaki Okano; Chinobu Sakai; Hirotaka Fukuyama; Takahito Kabai; Kouichirou Satou; Tetsuya Nakamura; Satoshi Katagata, all of Tokyo, Japan

[73] Assignee: Kabushiki Kaisha Toshiba, Kawasaki, Japan

[21] Appl. No.: 93,826

[22] Filed: Jul. 20, 1993

[30] Foreign Application Priority Data

Jul. 24, 1992 [JP] Japan ..... 4-198334
Aug. 31, 1992 [JP] Japan ..... 4-257321

[51] Int. Cl.[6] ..... G03G 15/08

[52] U.S. Cl. ..... 355/260; 523/205; 222/DIG. 1

[58] Field of Search ..... 355/260; 222/DIG. 1, 222/544, 541; 523/205

[56] References Cited

U.S. PATENT DOCUMENTS

| | | | |
|---|---|---|---|
| 4,151,136 | 4/1979 | Cornell | 523/205 |
| 4,210,573 | 7/1980 | Cornell | 524/188 |
| 4,981,218 | 1/1991 | Ban et al. | 355/260 X |
| 5,194,900 | 3/1993 | Hagihara et al. | 355/260 |
| 5,229,824 | 7/1993 | Tsusaka et al. | 222/DIG. 1 |

*Primary Examiner*—R. L. Moses
*Attorney, Agent, or Firm*—Finnegan, Henderson, Farabow, Garrett & Dunner

[57] ABSTRACT

A toner pack for use in an electrophotographic apparatus is formed of a polypropylene resin containing 30 to 50 wt % calcium carbonate filler. This resin has a high deformability, and generates a small amount of heat at the time of incineration thereof. Thus, the used toner pack can be disposed of together with flammable products made of paper and/or wood. Further, at the time of disposal, it is possible to fold the used toner pack to reduce its size.

35 Claims, 5 Drawing Sheets

TONER PACK AND DEVELOPMENT DEVICE FOR USE IN ELECTROPHOTOGRAPHIC APPARATUS

BACKGROUND OF THE INVENTION

1. Field of the Invention

The present invention relates to a development device used in an electrophotographic apparatus for developing an electrostatic latent image to form a toner image, and also to a container of consumption articles used in the same, such as a toner pack and a used-toner tank.

2. Description of the Related Art

The development device of the electrophotographic apparatus such as a facsimile apparatus and a copying machine develops, by use of toner, an electrostatic latent image formed on a photosensitive drum to thereby form a visible image (toner image). The development device has a toner holder, and uses toner contained therein to perform development. Toner in the toner holder is gradually reduced as it is consumed, and hence must be resupplied. Toner resupply is performed by the user with use of a toner pack so as to prevent the user's hand or clothes or the inside of the electrophotographic apparatus from being soiled by toner, that is, an empty toner pack mounted in the development device is exchanged with a new toner pack filled with the toner.

The toner pack is a toner container having a toner outlet sealed with a sheet member. The toner pack is formed by subjecting a polystyrene resin, an ABS (acrylonitrile-butadiene-styrene) resin, or a polyethylene resin to injection molding. At the time of resupply of toner, an empty toner pack is detached from the toner holder of the development device, and a new toner pack is mounted in a predetermined position of the toner holder, thereafter removing the seal sheet from the new toner pack. Thus, toner is supplied through the toner outlet of the toner pack into the toner holder of the development device. The detached used or empty toner pack is disposed of.

The conventional toner pack made of a polystyrene resin, an ABS resin, or a polyethylene resin causes such a problem as described below when it is disposed of.

when these resin materials are incinerated, they generate a larger amount of heat than paper, cloth, and wood, which are easy to incinerate. Thus, the walls of an incinerator can easily be damaged, which makes it difficult to incinerate the resin materials forming the toner pack. Therefore, fit is necessary at the time of disposal to separate resin products from flammable products made of paper, cloth, or wood. This is troublesome for the user.

Further, the above described resin materials are hard to bend or crush. Thus, it is difficult to reduce the size of the used toner pack by crushing or folding, and hence the toner pack is inevitably bulky.

The used-toner tank also has the above drawbacks.

SUMMARY OF THE INVENTION

It is a first object of the present invention to provide a container of consumption articles used in an electrophotographic apparatus, which can become small in size at the time of disposal and be incinerated in an incinerator without damaging the incinerator, i.e., which can easily be disposed of.

It is a second object of the present invention to provide a toner pack for use in an electrophotographic apparatus, having a easily removable seal sheet which seals a toner outlet thereof for supplying toner therethrough to a development device of the electrophotographic apparatus.

It is a third object of the present invention to provide a development device for use in an electrophotographic apparatus, which keeps a toner pack mounted on a toner holder in a stable manner.

According to the present invention, the first object is achieved by a container of consumption articles used in an electrophotographic apparatus and formed of a polyolefin-based resin including mineral filler.

The second object of the present invention is achieved by a toner pack for use in an electrophotographic apparatus, comprising a main body containing toner; a toner outlet formed in one surface of the main body; and a seal sheet adhered to the main body for sealing the toner outlet, an adhesive portion of the seal sheet at the main body being a loop around the toner outlet, the loop having a hexagonal or an elliptical shape.

The third object of the present invention is achieved by a development device for use in an electrophotographic apparatus, comprising a housing having a toner holder, and a toner inlet formed in an upper portion of the toner holder; a toner pack having a toner outlet formed in one surface thereof, and a seal sheet adhered to the toner pack for sealing the toner outlet, thereby containing toner therein; and means for urging the toner pack toward the housing.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE PREFERRED EMBODIMENTS

A preferred embodiment of the present invention will now be described with reference to the accompanying drawings.

Figure 1:
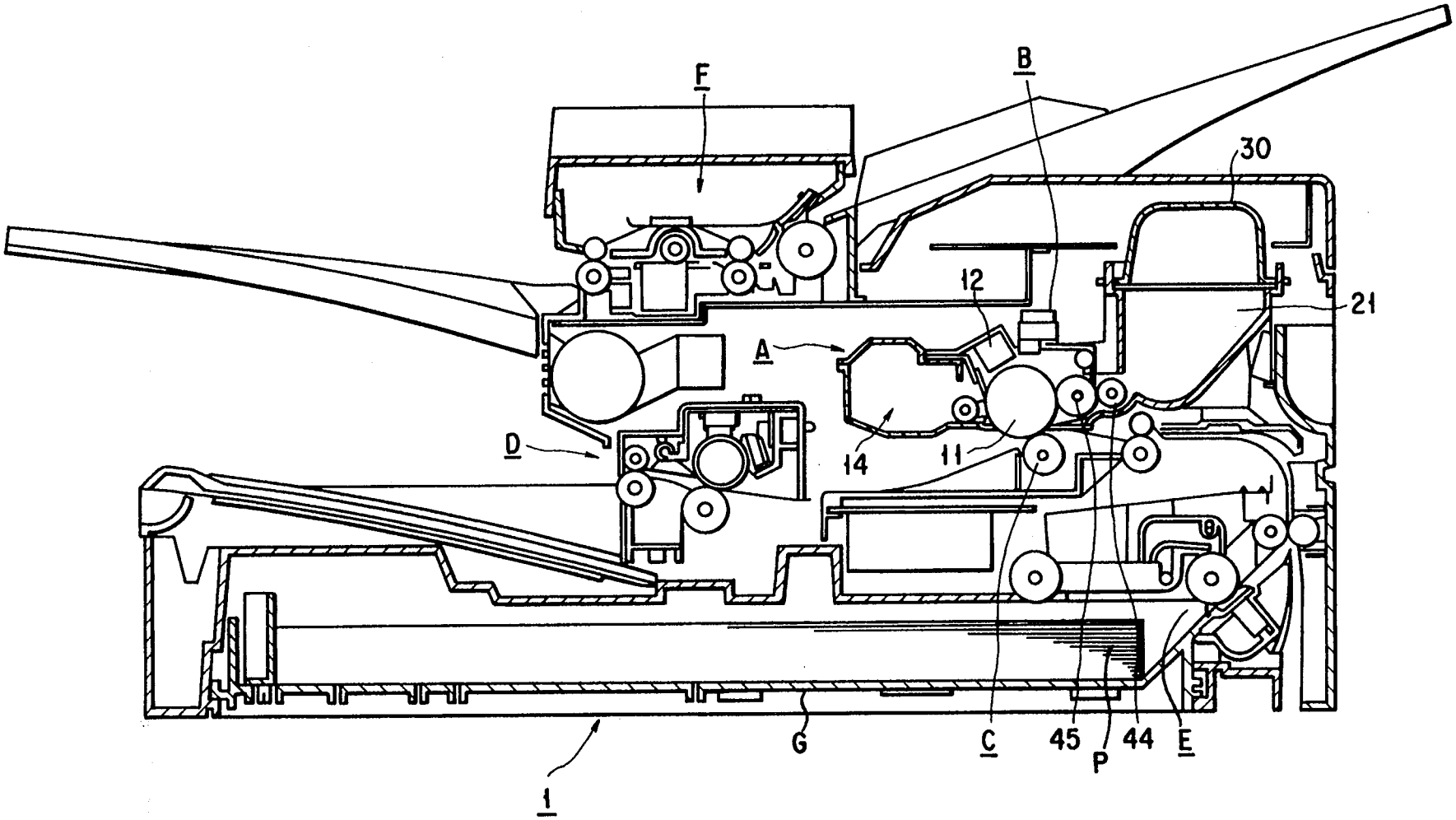
FIG. 1 is a cross sectional view, showing the overall arrangement of a facsimile apparatus as an embodiment of the present invention.

FIG. 1 is a cross sectional view, showing the overall arrangement of a facsimile apparatus equipped with a development device according to a first embodiment of the present invention. As is shown in FIG. 1, the facsimile apparatus is formed of a process unit A, an exposure unit B, a transfer unit C, a fixing unit D, a paper feeder E, a transmission unit F, and a sheet tray G.

The process unit A comprises a photosensitive drum 11, a charger 12, a development device 13, and a cleaner 14, which are formed integral as one body. The process unit A forms a toner image on the photosensitive drum 11 by means of the so-called Carlson process, together with the exposure unit B. The process unit A is detachably mounted in an apparatus main body 1.

The exposure unit B has an LED head for exposing the photosensitive layer of the drum 11 to form an electrostatic latent image. The transfer unit C has a transfer roller for transferring the toner image formed on the drum 11, onto a recording sheet P of paper stored in the sheet tray G and fed by the paper feeder F. The fixing unit D fixes the toner image transferred on the paper sheet.

The transmission unit G optically reads an image of a document to be transmitted to another facsimile apparatus, and performs photoelectric conversion to generate an image signal.

Figure 2:
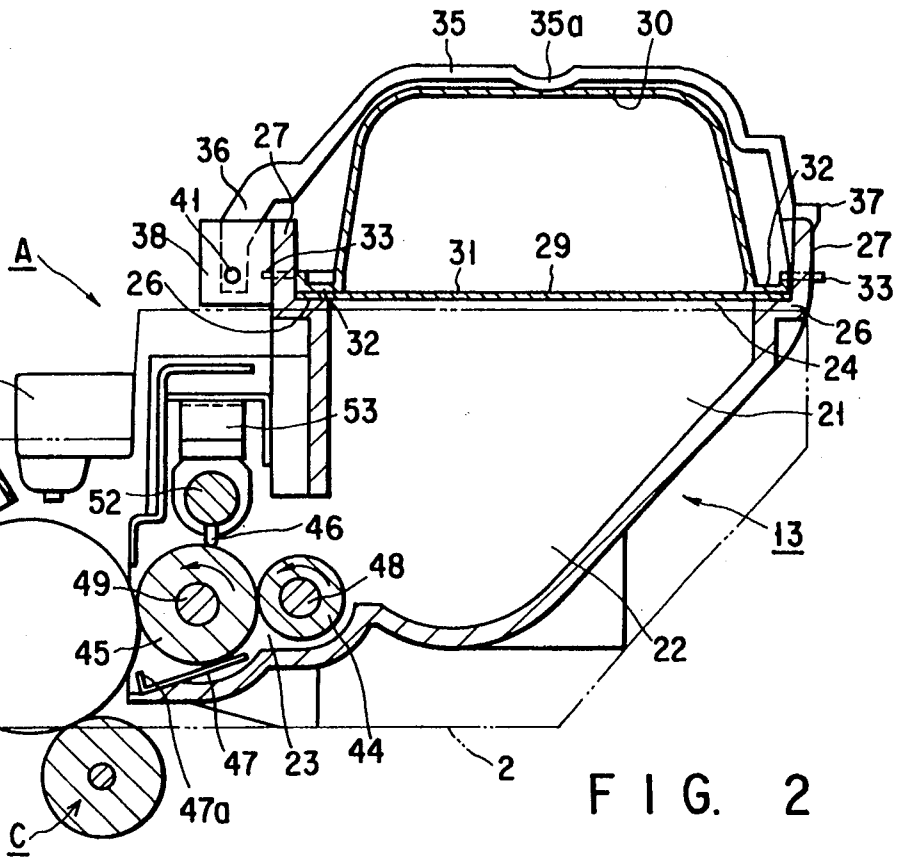
FIG. 2 is a cross sectional view, showing in detail the structure of a process unit included in the facsimile apparatus shown in FIG. 1.

The details of the process unit A will be described with reference to FIGS. 2 and 3. In FIG. 2, elements similar to those shown in FIG. 1 are denoted by the same reference numerals.

In the process unit A, the charger 12, developing unit 13, and cleaner 14 are provided around the photosensitive drum 11, and are supported as one body by unit plates 2 located on the right and left sides of the process unit A.

The photosensitive drum 11 comprises, for example, an aluminum cylinder and a photosensitive layer made of a photosensitive conductive material and formed on the aluminum cylinder, and is rotatable by a rotary driving mechanism (not shown) in a counter-clockwise direction indicated by the arrow shown in FIG. 2.

The charger 12 comprises a known scorotron charger for uniformly charging the surface of the drum 11 to keep it at a predetermined potential.

The cleaner 14 has a cleaning blade 15, a used-toner receiving tank 16, a transfer roller 17, and a one-way valve-18. The cleaning blade 15 removes the toner remaining on the photosensitive drum 11 even after the transfer process by the transfer unit C is finished. The transfer roller 17 transfers the remaining (i.e. used) toner removed by the cleaning blade 15 to the used-toner receiving tank 16. The one-way valve 18 prevents the toner received in the tank 16, from returning toward the drum 11.

The development device 13 which is an essential part of the present invention will be described in detail.

The development device 13 has a unit case 21, a toner pack 30, an urging member 35, a supply roller 44, a development roller 45, a development blade 46, a receiving blade 47, a holding bar 52, and a spring member 53.

The unit case 21 has substantially the same width as the photosensitive drum 11, and is located parallel therewith. The unit case 21 houses a toner holder 22, and a roller-located portion 23 between the toner holder 22 and the drum 11. The toner holder 22 communicates with the roller-located portion 23, and has an upper surface in which a rectangular toner inlet 24 is formed in the axial direction of the photosensitive drum 11.

Figure 3:
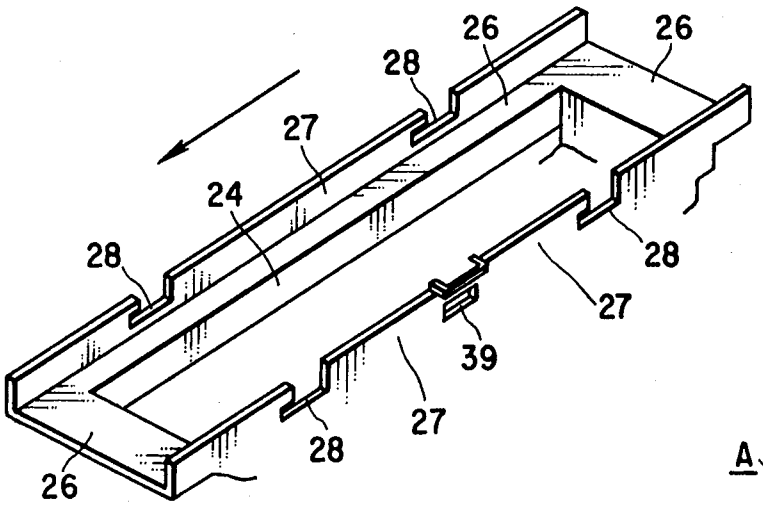
FIG. 3 is a perspective view, showing a structure in the vicinity of a toner inlet of a development device of the facsimile apparatus of FIG. 1.

As shown in FIG. 3, a horizontal flange 26 is formed around the toner inlet 24, and has ribs 27 formed in the longitudinal direction of the toner inlet 24. Each rib 27 has two cutout portions 28. An elastic seal member 29 (FIG. 2) made of e.g. sponge is adhered to the upper surface of the flange 26 around the toner inlet 24.

There are provided the supply roller 44, development roller 45, development blade 46, and the receiving blade 47 at the roller-located portion 23 of the unit case 21.

The supply roller 44 is made of a synthetic resin, and fixed to a roller shaft 48, which is rotatably supported by side walls of the unit case 21. The development roller 45 is also made of a synthetic resin, and is fixed to a roller shaft 49, which is rotatably supported by side walls of the unit case 21. The development roller 45 is in contact with the supply roller 44 and photosensitive drum 11.

The supply roller 44 and development roller 45 are rotated by a rotating mechanism (not shown) in a clockwise direction indicated by the arrow shown in FIG. 2. The supply roller 44 transfers toner from the toner holder 22 of the unit case 21, to the development roller 45. The development roller 45 transfers the received toner to the photosensitive drum 11.

The development blade 46 is made of a synthetic resin, and fixed to a support bar 52. The support bar 52 is located above the development roller 45 in parallel therewith, with the development blade 46 attached to a lower portion thereof. The support bar 52 is supported by side walls of the case 21 such that it can be displaced in the vertical direction.

The spring member 53 urges the support bar 52 downward, and hence the development blade 46 contacts the development roller 45. Thus, toner carried on the roller 45 is made to a thin layer and charged with electricity by a frictional force caused therebetween.

The receiving blade 47 is made of e.g., a metal plate with elasticity, and is located under the development roller 45, close to the photosensitive drum 11, and parallel with the development roller 45. Further, the blade 47 is located on the bottom surface of the roller-located portion 23 of the unit case 21 such that a rear portion of the blade 47 contacts the development roller 45.

The receiving blade 47 prevents toner contained in the roller-located portion 23 from escaping from downward of the development roller 45 to the outside thereof, and also guides toner, which has fallen from the development roller 45, to the interior of the roller-located portion 23 in accordance with rotation of the development roller 45.

Further, the receiving roller 47 has an upwardly bent portion **47*a* close to the photosensitive drum 11, for preventing toner received therein, from escaping to the drum 11**.

The toner pack 30 is formed of polypropylene including 30 to 50 wt % calcium carbonate filler. That is, the weight of the filler is 30 to 50% of the total weight of the polypropylene and the filler. The toner pack 30 has a rectangular parallelepiped shape with substantially the same size as the toner inlet 24 and an average thickness of 0.8 mm. This pack is formed by vacuum molding. The pack 30 has a rectangular toner outlet 31 formed in its lower surface in the longitudinal direction. A flange 32 is formed around the toner outlet 31. The flange 32 has claws 33 formed in the longitudinal direction. The claws 33 are detachably engaged with the cutout portions 28 of the case unit 21 shown in FIG. 3.

Figure 4:
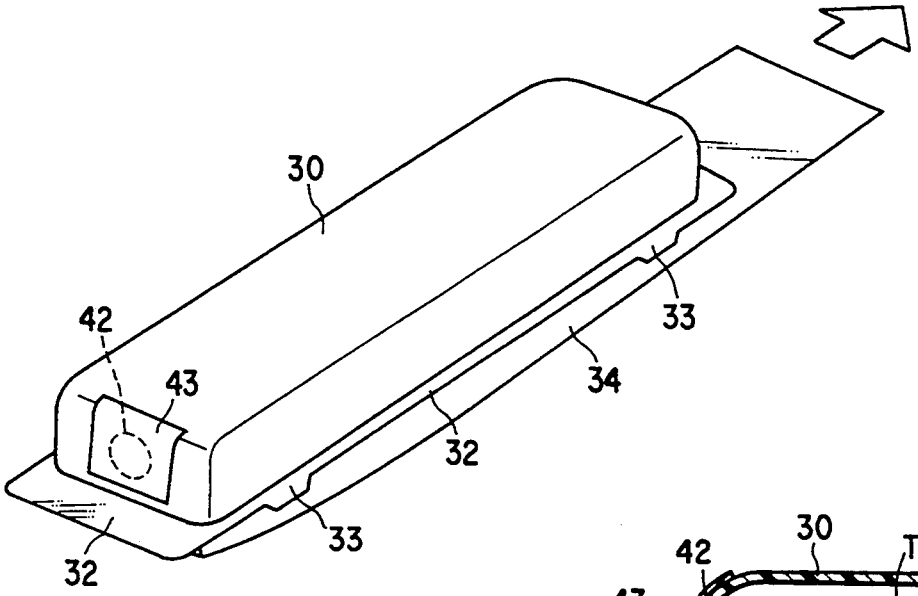
FIG. 4 is a perspective view, showing the structure of a toner pack used in the development device of the facsimile apparatus of FIG. 1.
Figure 5:
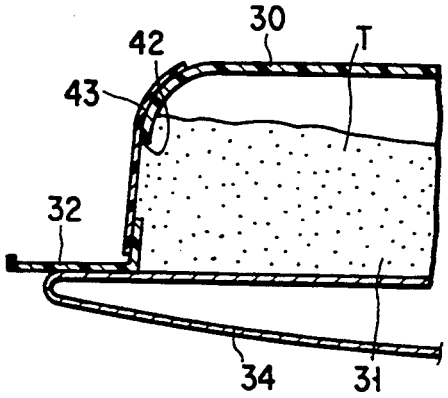
FIG. 5 is a cross sectional view, showing part of the toner pack of FIG. 4.

As is shown in FIGS. 4 and 5, the outlet 31 of the toner pack 30 is sealed with a seal sheet 34 fixed to the flange 32 by thermal pressing. The sheet 34 is formed of a resin film. The toner inlet 42 is formed in one side of the toner pack 30 for filling the pack 30 with toner T therethrough after the outlet 31 of the toner pack 30 is sealed with the seal sheet 34. After supplying toner T into the pack 30 through the toner inlet 42, the inlet 42 is sealed with a seal chip 43 made of a flammable resin, such as a synthetic paper formed of a resin and a paper. Thus, toner T is sealed in the pack 30.

The toner pack 30 is mounted on an upper portion of the unit case 21. The manner of mounting the pack 30 will now be explained. Each claw 33 of the pack 30 is inserted into a corresponding cutout portion 28, and then the pack 30 is moved in the longitudinal direction indicated by the arrow shown in FIG. 3 to thereby engage the claw with the engagement portion of the cutout portion 28. Thus, the flange 32 of the pack 30 is placed on the seal member 29 of the unit case 21.

As shown in FIG. 4, if a free end of the seal sheet 34 is pulled in a direction indicated by the arrow shown in FIG. 4, then it is removed from the pack 30, with the result that toner T drops from the pack 30 into the toner holder 22 through the toner outlet 31 and toner inlet 24.

To remove the toner pack 30 from the unit case 21, the claws 33 are disengaged from the cutout portions 28 by moving the pack 30 in the opposite direction of the arrow shown in FIG. 3, and the pack 30 is raised upward. The removed toner pack 30 is no more necessary, and hence is disposed of and incinerated.

As is described above, the toner pack 30 is made of polypropylene including 30 to 50 wt % calcium carbonate filler. In general, the resin formed of polypropylene including 30 to 50 wt % calcium carbonate filler generates a relatively small amount of heat when it is incinerated, and therefore does not generate a black smoke or a chlorine compound.

The following table shows the amount of heat generated and whether or not black smoke and noxious gas are generated, when each material is incinerated.

| MATERIAL | CALORIFIC VALUE Kcal/Kg | BLACK SMOKE NOXIOUS GAS |
|---|---|---|
| POLYPROPYLENE | APPROX. 11,000 | NONE |
| POLYETHYLENE | APPROX. 11,000 | NONE |
| POLYSTYRENE | APPROX. 9,900 | BACK SMOKE GENERATED |
| POLYPROPYLENE CONTAINING 30 wt % MINERAL FILLETER | APPROX. 7,700 | NONE |
| POLYPROPYLENE CONTAINING 50 wt % MINERAL FILLER | APPROX. 5,500 | NONE |
| POLYVINYLCHLORIDE | APPROX. 4,400 | CHLORINE COMPOUND GENERATED |
| PAPER | APPROX. 4,400 | NONE |

As is evident from the table, a polyolefin-based resin such as polypropylene or polyethylene does not generate such a noxious gas or a black smoke. Further, adding calcium carbonate filler to the polyolefin-based resin can reduce the amount of heat generated. Accordingly, a toner pack made of a polypropylene resin including more than 30 wt % calcium carbonate filler will not damage an incinerator when it is incinerated therein. However, the more the content of the calcium carbonate filler, the less the productivity of the resin. In light of this, the upper limit of the content of the filler is set to approx. 50 wt %.

Although a polypropylene resin is used in the above embodiment, the base resin is not limited to it, but may be any polyolefin-based resin such as a polyethylene resin. Moreover, it is confirmed that magnesium silicate can be used as the mineral filler, as well as calcium carbonate.

In summary, since the toner pack 30 according to the present invention can be incinerated with no problem in an incinerator, it can be disposed of together with flammable products made of paper and/or wood.

Figure 6A:
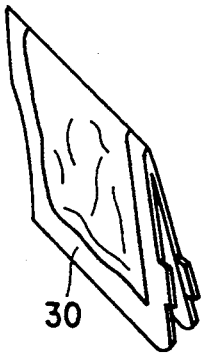
FIGS. 6A and 6B are views explaining a comparison between a folded state of a toner pack according to the present invention and that of a conventional toner pack.

In addition, a polyolefin-based resin containing mineral filler has a relatively low elasticity due to the existence of mineral. FIG. 6A shows a toner pack 30 according to the present invention which is folded with its toner outlet kept inside. Thus, the toner pack 30 can easily be deformed and crushed by the user when it has a thickness of 1 mm or less, and the deformed and crushed pack will hardly be restored to its original state. Further, if the thickness of the pack is 0.3 mm or less, the pack can easily be torn by the user, which means that it can be handled like paper. Accordingly, at the time of disposal, it is possible to fold or crush the toner pack 30 to reduce its size so as to prevent it from occupying a large space.

Moreover, since the conventional toner pack is formed of polystyrene resin, ABS resin, or polyethylene resin, the toner pack is much more rigid than the seal sheet. If the atmospheric pressure is changed during air transportation of the toner pack, the seal sheet may be broken and the toner is scattered. According to the present invention, however, the toner pack 30 can easily be deformed in accordance with a change in atmospheric pressure, which means that the influence of the change in atmospheric pressure can be dispersed.

Therefore, the seal sheet can be prevented from being broken due to a change in pressure.

Figure 6B:
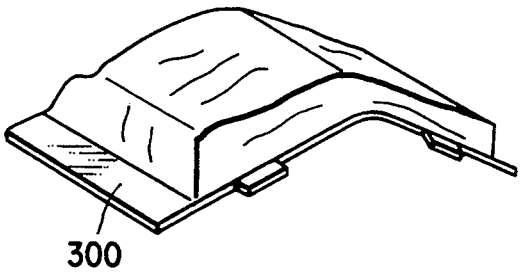

FIG. 6B shows a toner pack 300 which is made of a polypropylene resin containing no mineral filler, has the same shape as the toner pack 30 of the above embodiment, and is folded in a manner similar to the case shown in FIG. 6A. In this case, the resin of the pack 300 has a high elasticity, and hence the pack 300 will be restored to its original shape if the user lets go his hold of the pack 300 after bending the same. Therefore, it is difficult to deform or crush the toner pack 300, and to tear the same even if it has a thickness of about 0.3 mm.

In the above description, although the toner pack is described as an embodiment of the container of consumption articles used in an electrophotographic apparatus, the present invention can be limited to the toner pack. For example, the present invention is applicable also to a detachable used-toner tank for receiving used toner, which is to be disposed of after being full of used toner.

Figure 7:
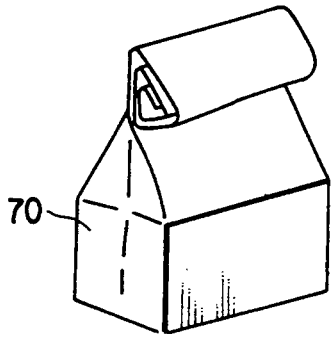
FIG. 7 is a perspective view, showing a used-toner container as another embodiment of the container according to the present invention.

FIG. 7 is a view of a used-toner container 70 formed of a material including a polypropylene resin and a mineral filler, showing a state in which its opening is bent to be disposed of. Since the polypropylene resin containing a mineral filler-has a plasticity property, the opening of the container 70 is bent to close itself without using a cap or the like. The size of the container 70 is reduced by bending the opening and folding the entire body. Thus, the used-toner container 70 does not occupy a large space at the time of disposal.

As is described above, the toner pack 30 formed of polyolefin-based resin adding a calcium carbonate can easily be deformed than the conventional toner pack formed of polystyrene resin, ABS resin, or polyethylene resin. Thus, if a large force is applied to the toner pack 30 when the seal sheet 34 is peeled off the pack 30, it is possible that the toner pack 30 is deformed.

Figure 8A:
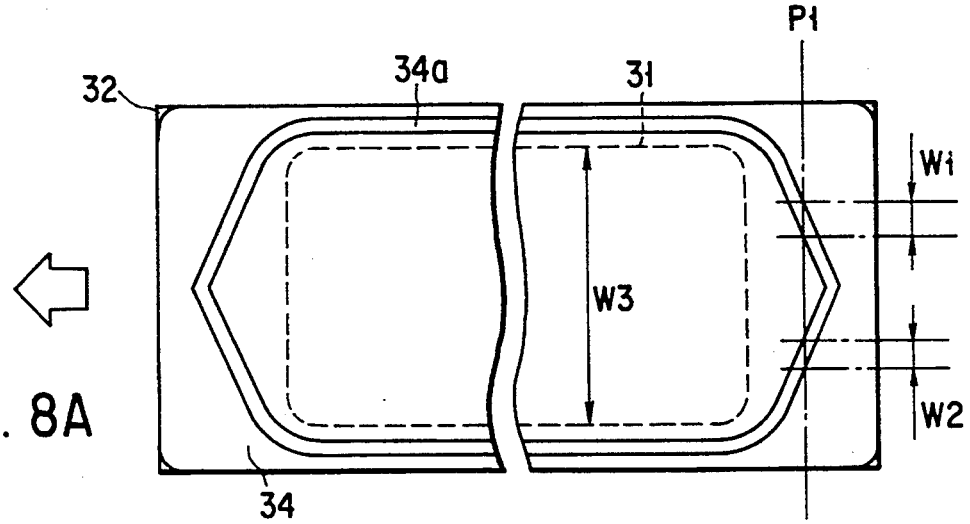
FIGS. 8A and 8B are plan views, showing a seal sheet adhesion portion of a toner pack according to the present invention and that of a conventional toner pack.

In order to prevent this deformation, a seal portion 34*a* of the seal sheet 34, which is to be adhered to the flange 32 of the toner pack 30, is not a rectangular shaped loop around the toner outlet 31 but a long hexagonal or an elliptical shaped loop, as shown in FIG. 8A. This means that the total width of any part of the seal portion 34*a*, which is in a direction perpendicular to a direction in which the seal sheet 34 is peeled off, is sufficiently smaller than the width of the toner outlet 31 of the pack 30. For example, the total width of the seal portion 34*a* at a position P1 (FIG. 8A), which is in a direction perpendicular to the peeling direction, is the sum of widths W1 and W2. This sum is much smaller than the width W3 of the toner outlet 31. The same can be said of any other position of the seal portion 34*a*.

Figure 8B:
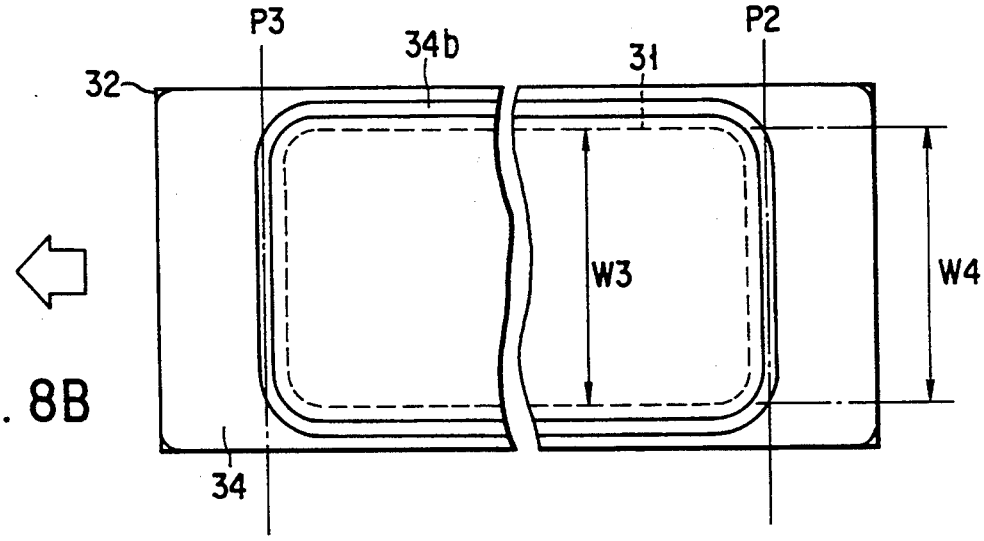

On the other hand, in general, a rectangular seal portion 34*b* is formed around the toner outlet 31, as shown in FIG. 8B. In this case, the width W4 of the seal portion 34*b*, which is in a direction perpendicular to the peeling direction, is equal to the width W3 of the toner outlet 31 in a position P2 or P3.

The force required to peel the seal sheet 34 off the toner pack 30 is substantially proportional to the width of the seal portion 34*a* or 34*b*, which is in a direction perpendicular to the peeling direction. Accordingly, the embodiment shown in FIG. 8A requires a smaller force than the conventional case shown in FIG. 8B, to peel the seal sheet 34 off the toner pack 30. Thus, the toner pack 30 can be prevented from being deformed at the time of peeling the seal sheet.

The shape of the seal portion 34*a* is not limited to that shown in FIG. 8A. However, it suffices if the width of any portion of the seal portion 34*a*, which is in a direction perpendicular to the peeling direction, is smaller than the width of the toner outlet 31. Triangular portions of both ends of the long hexagonal seal portion 34*a* may be modified to arc portions or stepwise portions.

Further, the hexagonal shape of the seal portion 34*a* is effective not only to the toner pack 30 made of polypropylene containing a mineral filler, but also to the conventional toner pack. In the latter case, too, peeling of the seal sheet 34 can be performed smoothly.

The deformability of the toner pack 30 according to the present invention is liable to create a clearance between itself and the unit case 21 when it is mounted thereon. In order to avoid this, the urging member 35 is provided on the development device 13. The details of the urging member 35 will be described below.

Figure 9:
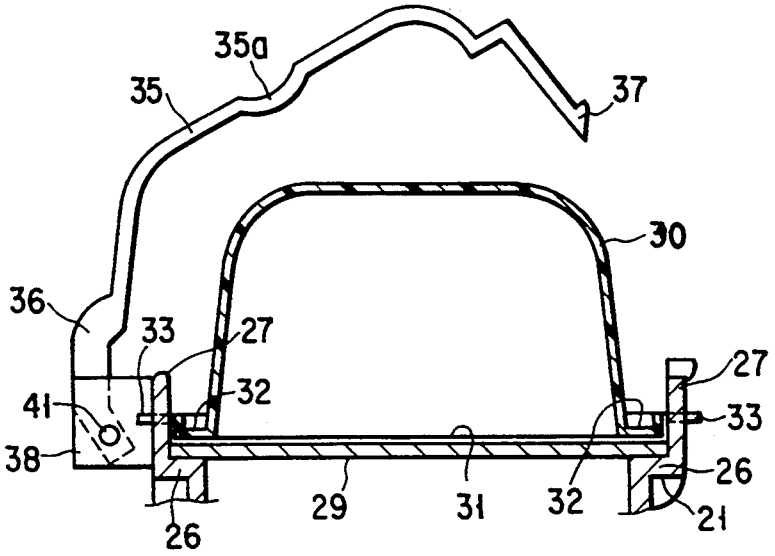
FIG. 9 is a sectional side view, showing a mechanism for fixing the toner pack to a toner holder of the. development device.
Figure 10:
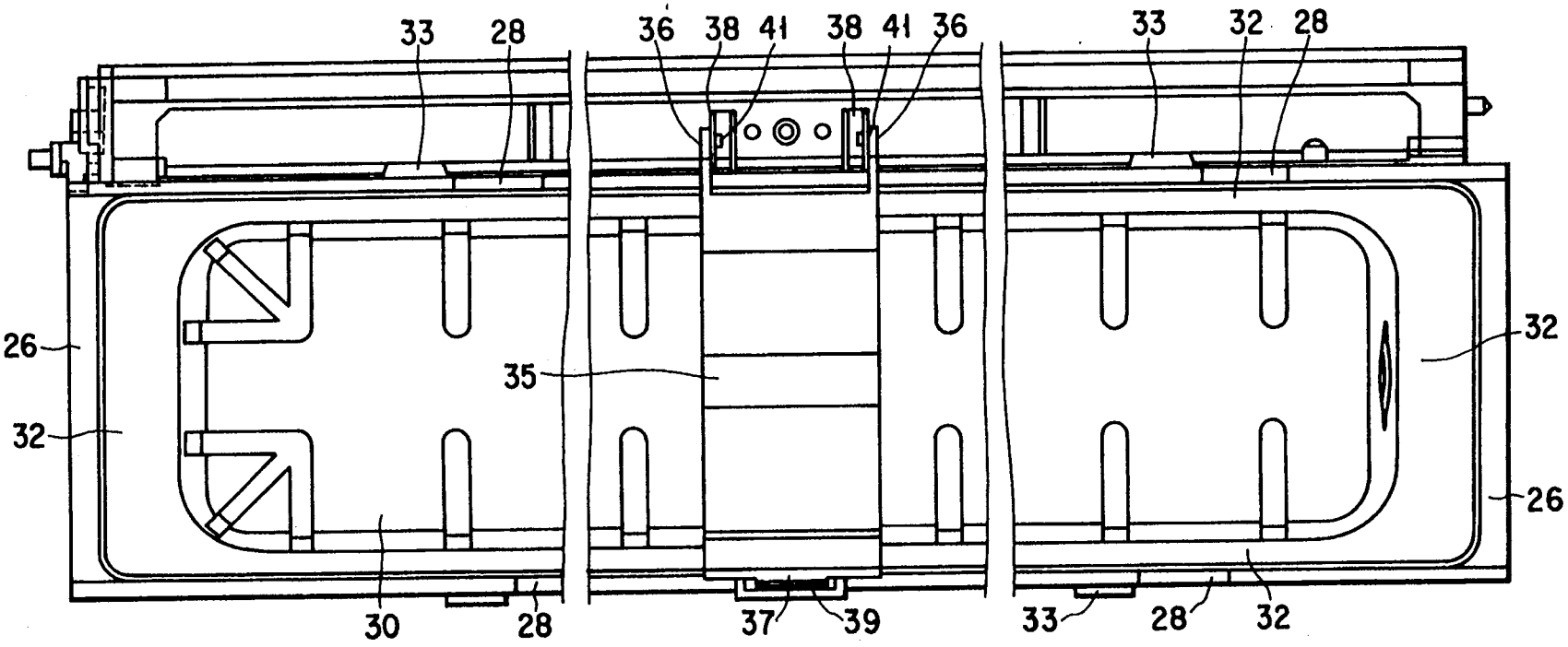
FIG. 10 is a plan view, showing the mechanism of FIG. 9.

As is shown in FIGS. 2, 9, and 10, the urging member 35 is formed of a C-shaped synthetic resin plate member covering the toner pack 30 from above. The urging member 35 has an end provided with a pair of pivoted members 36, and the other end provided with a claw 37. The projection 35*a* for pressing the toner pack 30 extends at a central portion of the urging member 35 in a width direction (in the longitudinal direction of the toner pack).

The unit case 21 has a pair of pivoted members 38 provided outside the rib 27 at a central portion of one of the side portions of the unit case 21 which extend along the length of the toner outlet 24. The cutout portion 39 is formed in the rib 27 provided at the other side portion of the unit case 21 for engaging with the claw 37.

The pivoted members 36 of the urging member 35 are rotatably secured to the pivoted members 38 of the unit case 21 by means of a pin 41. Thus, the urging member 35 is supported by the unit case 21 such that it can rotate in a direction close to/away from the upper surface of the toner pack 30.

When the urging member 35 is in a position away from the toner pack 30 mounted on the case 21 and hence fixing of the toner pack 30 by the urging member 35 is released, as is shown in FIG. 9, a slight clearance exists between each claw 33 and a corresponding long cutout portion 28, which enables the toner pack 30 to move in the vertical direction. Accordingly, the resistance applied to the seal sheet 34 is small, and hence the sheet can be peeled off easily.

When the urging member 35 is rotated to the toner pack 30 and the claw 37 is engaged with the cutout portion 39, as is shown in FIG. 2, the projection 35*a* of the member 35 urges an upper central portion (a longitudinally and width-directionally central portion) of the toner pack 30 from above (outside). In other words, fixing the opposite ends of the urging member 35 causes an elastic force for pressing the toner pack 30 to fix the toner pack 30 to the unit case 21.

As a result, the toner pack 30 is moved down to press the seal member 29, and the flange 26 of the pack 30 tightly contacts with the flange 32 of the unit case 21, with the seal member 29 interposed therebetween. In particular, since the urging member 35 urges an upper central portion of the toner pack 30, the urging force of the member 35 is reliably applied to the entire pack 30. Therefore, no toner T will escape from between the flange 32 of the pack 30 and the flange 26 of the unit case 21.

Thus, the seal sheet 34 can easily be peeled off the toner pack 30 mounted on the unit case 21 when the urging member 35 is released from the cutout portion 39, and the toner can be prevented from escaping from between the case 21 and the pack 30 when the urging member 35 is engaged with the cutout portion 39.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents. For example, the shape and location of the urging member 35 for fixing the toner pack 30 is not limited to the above-described one. Further, the urging member 35 is effective not only to the toner pack 30 formed of polyolefin-based resin containing a mineral filler, but also to the conventional toner pack formed of polystyrene resin, ABS resin, or polyethylene resin since it can reliably maintain the toner pack, mounted on the unit case, in a stable manner.

What is claimed is:

1. A toner pack detachably mounted to a developing device of a frictional charging type of an electrophotographic apparatus and formed of a polyolefin-based resin including a mineral filler, the mineral filler being calcium carbonate, the toner pack including an inlet, sealed with a flammable sheet, for filling the toner pack with toner.

2. The toner pack according to claim 1, in which said mineral filler is not less than 30 wt % of the toner pack.

3. The toner pack according to claim 1, in which said mineral filler is not more than 50 wt % of the toner pack.

4. The toner pack according to claim 1, in which a thickness of the toner pack is not larger than 1 mm.

5. A toner pack for use in a development device of an electrophotographic apparatus, comprising:

a main body containing toner, which is formed of a polyolefin-based resin including a mineral filler;

a toner outlet formed in one surface of the main body; and a seal sheet adhered to the main body for sealing the toner outlet, an adhesive portion of the seal sheet at the main body being a loop around the toner outlet, the loop having a hexagonal or an elliptical shape.

6. A toner pack according to claim 5, in which said mineral filler is not less than 30 wt.% of the main body.

7. A toner pack according to claim 5, In which said mineral filler is not more than 50 wt % of the main body.

8. A toner pack according to claim 5, in which said mineral filler is calcium carbonate.

9. A toner pack according to claim 5, in which said mineral filler is magnesium silicate.

10. A toner pack according to claim 5, in which a thickness of the main body is not larger than 1 mm.

11. A toner pack according to claim 5, in which an inlet for filling the main body with toner is sealed with a flammable sheet.

12. A toner pack for use in a development device of an electrophotographic apparatus, comprising:

a main body containing toner, which is formed of a polyolefin-based resin including a mineral filler;

a toner outlet formed in one surface of the main body; and a seal sheet adhered to the main body for sealing the toner outlet, any portion of an adhesive portion of the seal sheet at the main body having a width, which is in a direction perpendicular to a direction in which the seal sheet is to be peeled off the main body, smaller than a width of the toner outlet.

13. A toner pack according to claim 12, in which said mineral filler is not less than 30 wt % of the main body.

14. A toner pack according to claim 12, in which said mineral filler is not less than 50 wt % of the main body.

15. A toner pack according to claim 12, in which said mineral filler is calcium carbonate.

16. A toner pack according to claim 12, in which said mineral filler is magnesium silicate.

17. A toner pack according to claim 12, in which a thickness of the main body is not larger than 1 mm.

18. A toner pack according to claim 12, in which an inlet for filling the main body with toner is sealed with a flammable sheet.

19. A development device for use in an electrophotographic apparatus, comprising:

a housing having a toner holder, and a toner inlet formed in an upper portion of the toner holder;

a toner pack having a toner outlet formed in one surface thereof, and a seal sheet adhered to the toner pack for sealing the toner outlet thereby containing toner therein, the toner pack being detachable mounted to the housing; and means, provided in the housing and covering at least a portion of the toner pack, for ensuring an attachment of the toner pack to the housing.

20. A device according to claim 19, in which said toner pack is formed of a polyolefin-based resin including a mineral filler.

21. A device according to claim 20, in which said mineral filler is not less than 30 wt % of the toner pack.

22. A device according to claim 20, in which said mineral filler is not more than 50 wt % of the toner pack.

23. A device according to claim 20, in which said mineral filler is calcium carbonate.

24. A device according to claim 20, in which said mineral filler is magnesium silicate.

25. A device according to claim 20, in which a thickness of the toner pack is not larger than 1 mm.

26. A device according to claim 20, in which an inlet of the toner pack for filling the case with toner is sealed with a flammable sheet.

27. A device according to claim 19, in which said ensuring means comprises means for urging the toner pack toward the housing, the urging means connected to said housing at at least two points.

28. A device according to claim 27, in which said urging means comprises a C-shaped member having a first end with a pivotal member and a second end with a first engaging portion to be engaged with a second engaging portion in the housing.

29. A developing device comprising:

a toner case for containing toner, the case detachably mounted to a housing of the developing device;

a toner hopper for receiving the toner when the toner case is mounted to the housing;

a developing roller; and a toner friction member for charging the toner received in the toner hopper to a predetermined polarity by friction between the developing roller and the toner friction member, wherein the developing roller develops an electrophotographic latent image formed on a surface of a photosensitive member using the toner charged by the toner friction member, and the toner case is formed of a polyolefin-based resin including a mineral filler, the mineral filler being calcium carbonate.

30. A developing device comprising:

a toner case for containing toner, the case detachably mounted to a housing, the case formed of a polyolefin-based resin including a mineral filler;

a toner hopper for receiving the toner when the toner case is mounted to the housing; and a developing roller for developing an electrophotographic latent image formed on a surface of a photosensitive member using received toner in the toner hopper.

31. A developing device according to claim 30, in which said mineral filler is calcium carbonate.

32. An image forming apparatus comprising:

a photosensitive member;

charging means for charging the photosensitive member;

exposing means for exposing the charged photosensitive member to form a latent image on the photosensitive member;

developing means for developing the latent image with toner to form a developed toner image on the photosensitive member;

transferring means for transferring the developed toner image to a sheet-like material; and cleaning means, having a blade contacting the photosensitive member and a container which is detachably mounted to the cleaning means, the blade removing residual toner remaining on the photosensitive member after the transfer of the developed toner image and before a subsequent image is to be formed, and the removed toner accumulating in the container, wherein the container is formed of a polyolefin-based resin including a mineral filler.

33. A development device for use in an electrophotographic apparatus, comprising:

a housing having a toner holder, and a toner inlet formed in an upper portion of the toner holder;

a toner pack having a toner outlet formed in one surface thereof, and a seal sheet adhered to the toner pack for sealing the toner outlet, thereby containing toner therein, the toner pack being detachably mounted to the housing; and a C-shaped member, connected to the housing at at least two points and covering at least a portion of the toner pack, for urging the toner pack toward the housing to ensure attachment of the toner pack to the housing, the C-shaped member having a first end with a pivotal member and a second end with a first engaging portion to be engaged with a second engaging portion in the housing.

34. A device according to claim 33, in which said C-shaped member has a projection for pressing the toner pack at a central portion thereof.

35. A device according to claim 33, in which said first engaging portion is a claw and said second engaging portion is a cutout portion.

* * * * *

UNITED STATES PATENT AND TRADEMARK OFFICE

CERTIFICATE OF CORRECTION

PATENT NO. : 5,412,364

DATED : May 02, 1995

INVENTOR(S) : Michihisa IGUCHI et al

It is certified that error appears in the above-indentified patent and that said Letters Patent is hereby corrected as shown below:

Claim 6, Column 9, Line 50, change "wt." to --wt--.

Claim 7, Column 9, Line 57, change "In" to --in--.

Claim 19, Column 10, Line 27, after "outlet" insert --,--.

Claim 19, Column 10, Line 29, change "tachable" to --tachably--.

Signed and Sealed this

Thirteenth Day of February, 1996

Bruce Lehman

*Attest:*

BRUCE LEHMAN

*Attesting Officer*

*Commissioner of Patents and Trademarks*